United States Patent [19]

Warrick

[11] 3,942,654

[45] Mar. 9, 1976

[54] SELF-ADHERING SUPPORT

[75] Inventor: Phillip C. Warrick, Michigan City, Ind.

[73] Assignee: Performance Packaging, Inc., Michigan City, Ind.,

[22] Filed: Mar. 22, 1974

[21] Appl. No.: 453,986

[52] U.S. Cl. ..... 214/10.5 R

[51] Int. Cl.[2] ..... B65G 1/14

[58] Field of Search .... 214/10.5 R; 105/367, 369 S, 105/369 UL, 369 D; 248/119 R; 108/51–53; 206/501, 503, 504, 386

[56] References Cited

UNITED STATES PATENTS

| | | | |
|---|---|---|---|
| 2,784,131 | 3/1957 | Fletcher, Jr. | 214/10.5 R |
| 3,236,197 | 2/1966 | Rossner | 108/55 |
| 3,331,496 | 7/1967 | Marsden et al. | 108/51 X |
| 3,616,943 | 11/1971 | Brink | 214/10.5 R |

FOREIGN PATENTS OR APPLICATIONS

| | | | |
|---|---|---|---|
| 1,300,206 | 6/1961 | France | 214/10.5 R |

*Primary Examiner*—Frank E. Werner
*Attorney, Agent, or Firm*—Clarence A. O'Brien; Harvey B. Jacobson

[57] ABSTRACT

An elongated, adhesively-coated, load-sustaining, supporting member attachable to a load for assisting in transporting the load from one location to another and to facilitate stacking of load units. The member is generally of a rectangular parallelepiped shape and has an elongated side completely covered with a hot-melt, pressure-sensitive adhesive for securing the member to the load. An easily removable sheet protecting the adhesive layer is applied to the entire adhesive area to protect the adhesive until time of use. The member may be cut to size, as appropriate, for a given dimensioned load.

1 Claim, 3 Drawing Figures

SELF-ADHERING SUPPORT

FIELD OF THE INVENTION AND SUMMARY OF THE PRIOR ART

Known forms of adhesively coated spacing and/or supporting structures are evidenced by the following U.S. Patents:

U.S. Pat. No. 2,489,054, issued Nov. 22, 1949, to Sprolle, wherein adhesive areas are noted at 36 through 45, inclusive.

U.S. Pat. No. 3,112,715, issued Dec. 3, 1963, to Callahan, et al., wherein weight-carrying members 3—3 are adhesively secured to high strength paper 1.

U.S. Pat. No. 3,126,843, issued Mar. 31, 1964, to DeLaney, wherein inexpensive plastic supporting material is shown with layers of adhesive and paper stripping thereon.

U.S. Pat. No. 3,236,197, issued Feb. 22, 1966, to Rossner, wherein pressure-sensitive tape is used to form the fork-lift entry areas under a load.

U.S. Pat. No. 3,556,886, issued Jan. 19, 1971, to Reusser, wherein blocks may be used as spacers or supports with adhesive applied to only one surface of the spacers.

U.S. Pat. No. 3,567,068, issued Mar. 2, 1971, to Carfizzi, wherein cleats for supporting a load may be variously shaped, in cross-section, such as circular, semi-cylindrical, triangular, etc., as well as rectangular.

SUMMARY OF THE INVENTION

Among the objects and advantages of my invention are the following:

1. To provide a low-cost, easily cut to size or design supporting unit that may be readily adhered to the bottom of a load.

2. To provide such a support including a hot-melt, pressure-sensitive adhesive, with a layer of readily removable material, to protect the adhesive until the time of application of the supporting structure to a load.

These together with other objects and advantages which will become apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
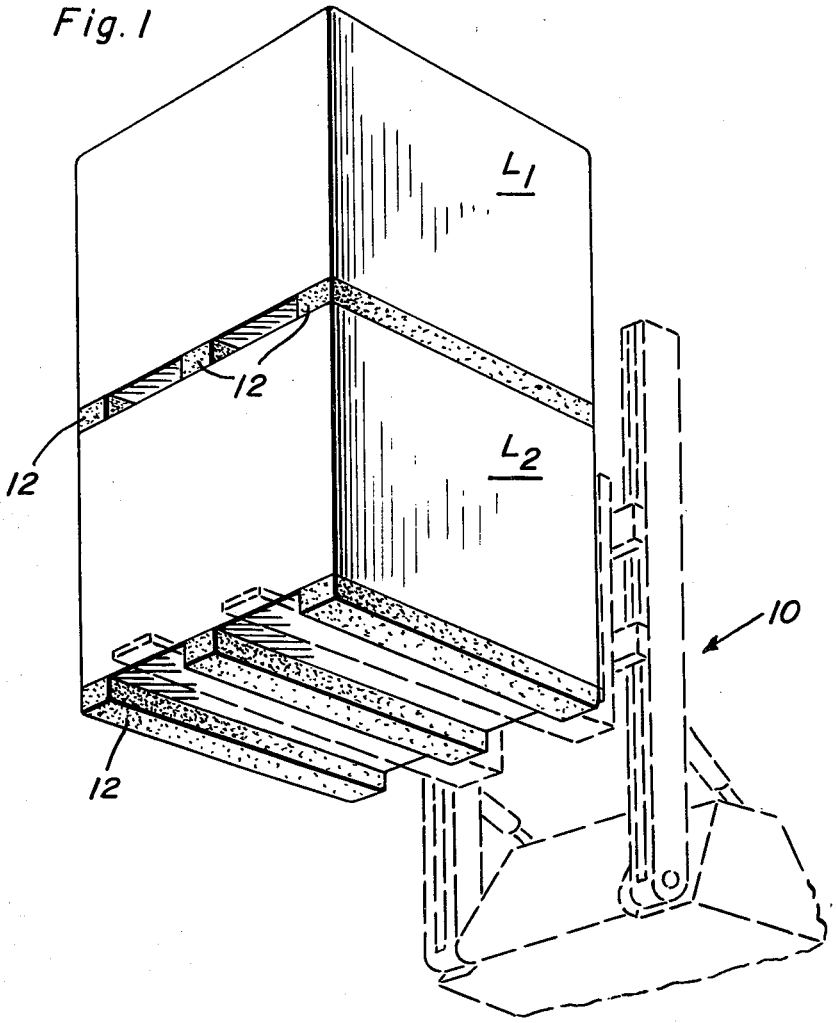
FIG. 1 is a perspective view of a plurality of my structures being used as both spacers and load supports, with a handling means for the load shown in phantom.
Figure 3:
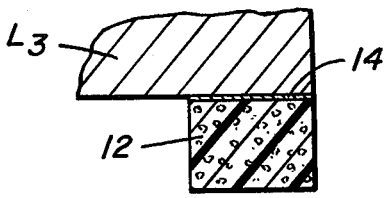
FIG. 3 is a cross-sectional view showing my support attached near one edge of a load.

The various loads are indicated by reference characters L1, L2, and L3 on FIGS. 1 and 3. The handling means, such as a conventional fork type lift truck, shown in phantom, is designated at 10. The block of supporting material is 12, the layer of adhesive is shown as 14, and the layer of strippable material is shown as 16.

The block of supporting material 12 may be of plastic, such as foamed polystyrene, wood, or similar, easily cut and shaped material. Preferably, whether wood or plastic, the material should be as non-absorptive as possible, where dampness or similar water problems are likely to be encountered. A non-absorptive foam plastic of sufficient strength to withstand the expected loads has proven most satisfactory.

The layer of adhesive 14 is a hot-melt, pressure-sensitive adhesive formulated from solid (at room temperatures) derivatives, heated to between 300° and 350°F. to flow and coat the supporting blocks. And, the layer 16 of protective material may be of paper or plastic constructed so that it will releasably adhere to the adhesive coating 14 and protect the adhesive during normal handling of the supports and yet is readily removable when desired.

Figure 2:
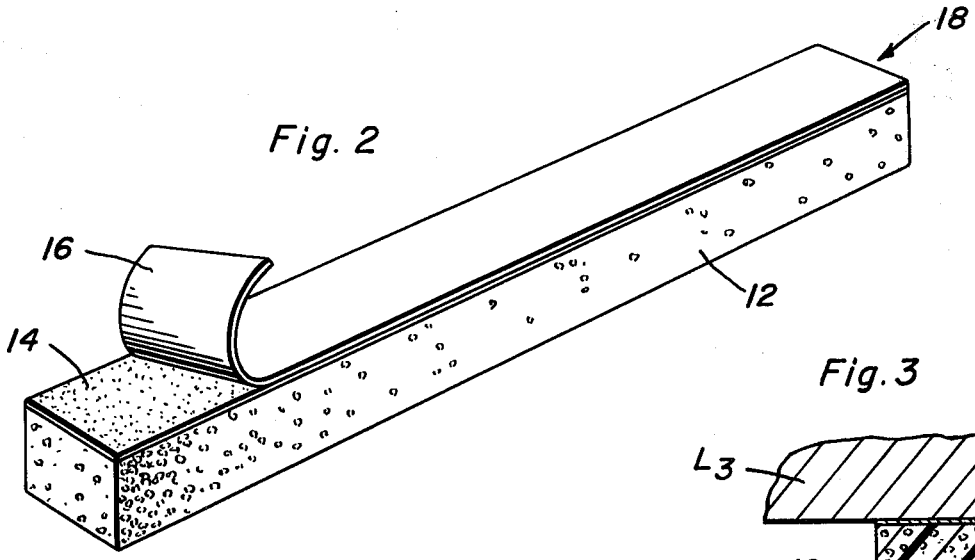
FIG. 2 is a perspective view of a single support, showing the protective stripping partially removed and exposing the adhesive surface.

Once the three layers of FIG. 2 have been assembled together, 18, all one has to do is cut the desired length needed, remove the strippable material 16, and apply the support to the bottom of the load. The specific number and location of such supports being determined by the size and weight of the load, and similar factors, present in both storage and transportation activities.

The supports or blocks 12 enable quick assembly with a load unit and will adhere to most relatively clean, flat surfaces thus resulting in considerable saving in time, labor and expense. Also, the supports 12 can be stored and transported to a point of use in less space than conventional wood pallets with the tare weight being less. The supports are capable of supporting several thousand pound loads and are so economical that expendable use thereof is feasible. The supports or blocks 12 may be attached to a load unit in various arrangements and by merely pressing it in position or positioning the blocks in desired position with the adhesive surfaces uppermost and placing the load unit thereon. The blocks may also serve as spacers for spacing load units horizontally as well as vertically and become an integral part of the load unit after attachment thereto.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a load unit having generally flat top and bottom surfaces and adapted to be lifted and transported by load handling means, such as a fork lift truck, and capable of vertical stacking with similar load units, and a plurality of supporting and spacing members attached directly to the bottom surface only of said load unit in a spaced pattern to support the load unit from a supporting surface and support an upper load unit from a lower load unit when stacked vertically to enable insertion of the forks of a fork lift truck between the members and under the bottom surface of the load unit for direct contact therewith for lifting and transporting the load unit, each supporting and spacing member including an elongated block of rigid material having a lateral dimension substantially less than the lateral dimension of the bottom surface of the load unit and including parallel opposed top and bottom surfaces, and a continuous coating of adhesive material on the top surface for self-adhering the member permanently to the flat bottom surface of the load unit, said block of material being constructed of lightweight rigid foam plastic material capable of being cut to desired dimensional characteristics prior to installation and being substantially non-absorbent for retaining its strength characteristics when exposed to contact with water or moisture, each block being rectangular and having end edges substantially coinciding with opposed edges of the bottom surface of the load unit to which it is attached thereby forming projections on only the bottom surface of the load unit to which the supporting and spacing members are mounted, said adhesive material being a pressure-sensitive, hot-melt adhesive formulated from solid derivatives, and a strippable protective sheet for protecting the adhesive coating prior to mounting of each block on the load unit.

* * * * *